US009117605B2

(12) United States Patent
An et al.

(10) Patent No.: US 9,117,605 B2
(45) Date of Patent: Aug. 25, 2015

(54) DC POWER RELAY

(71) Applicant: LSIS CO., LTD., Anyang-si, Gyeonggi-do (KR)

(72) Inventors: Jung Sik An, Seoul (KR); Hyun Woo Joo, Choongbuk (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 113 days.

(21) Appl. No.: 13/728,916

(22) Filed: Dec. 27, 2012

(65) Prior Publication Data

US 2013/0169389 A1 Jul. 4, 2013

(30) Foreign Application Priority Data

Dec. 30, 2011 (KR) ..... 10-2011-0146991

(51) Int. Cl.

| | |
|---|---|
| ***H01H 36/00*** | (2006.01) |
| ***H01H 1/54*** | (2006.01) |
| ***H01H 50/16*** | (2006.01) |
| ***H01H 50/54*** | (2006.01) |
| *H01H 9/44* | (2006.01) |
| *H01H 50/38* | (2006.01) |

(52) U.S. Cl.

CPC ..... *H01H 36/0073* (2013.01); *H01H 50/163* (2013.01); *H01H 50/546* (2013.01); *H01H 9/443* (2013.01); *H01H 50/38* (2013.01); *H01H 2001/545* (2013.01)

(58) Field of Classification Search

CPC ..... H01H 2001/545; H01H 9/443
USPC ..... 335/179
See application file for complete search history.

(56) References Cited

U.S. PATENT DOCUMENTS

| | | | | |
|---|---|---|---|---|
| 3,789,333 | A | 1/1974 | Kurpanek | |
| 4,367,448 | A * | 1/1983 | Nishizako | 335/201 |
| 6,124,771 | A * | 9/2000 | Kim et al. | 335/4 |
| 6,700,466 | B1 * | 3/2004 | Yamamoto et al. | 335/132 |
| 8,193,881 | B2 * | 6/2012 | Yuba et al. | 335/78 |
| 2009/0072935 | A1 * | 3/2009 | Yuba et al. | 335/201 |
| 2009/0322454 | A1 | 12/2009 | Tanaka et al. | |

(Continued)

FOREIGN PATENT DOCUMENTS

| | | |
|---|---|---|
| CN | 101908441 | 12/2010 |
| EP | 1548774 | 6/2005 |

(Continued)

OTHER PUBLICATIONS

Machine translation for JP 2008084807.*

(Continued)

*Primary Examiner* — Mohamad Musleh
(74) *Attorney, Agent, or Firm* — Lee, Hong, Degerman, Kang & Waimey

(57) ABSTRACT

Provided is a DC power relay. The DC power relay includes a pair of fixed contacts disposed parallel to each other, a movable contact vertically movable with respect to the pair of fixed contacts, the movable contact being in connect with or being separated from the pair of fixed contacts, a pair of permanent magnets for guide an arc generated when the movable contact is in contact with or is separated from the pair of fixed contacts to the outside, and a damping magnet reducing a force generated in a direction in which the movable contact is separated from the fixed contacts when the movable contact is in contact with the fixed contacts.

4 Claims, 4 Drawing Sheets

(56) References Cited

U.S. PATENT DOCUMENTS

| | | | | |
|---|---|---|---|---|
| 2011/0181381 | A1* | 7/2011 | Sasaki et al. | 335/78 |
| 2013/0057377 | A1* | 3/2013 | Yano et al. | 336/192 |
| 2013/0063232 | A1* | 3/2013 | Takaya et al. | 335/201 |

FOREIGN PATENT DOCUMENTS

| | | | |
|---|---|---|---|
| EP | 2197009 | | 6/2010 |
| EP | 2385536 | | 11/2011 |
| GB | 622381 | A * | 5/1949 |
| JP | 2002-175752 | | 6/2002 |
| JP | 2002-541621 | | 12/2002 |
| JP | 2006-59823 | | 3/2006 |
| JP | 2008084807 | | 4/2008 |
| JP | 2012199133 | | 10/2012 |
| KR | 20-2011-0007655 | | 8/2011 |

OTHER PUBLICATIONS

Korean Intellectual Property Office Application Serial No. 10-2011-0146991, Notice of Allowance dated Nov. 26, 2012, 2 pages.

Japan Patent Office Application Serial No. 2012-286057, Office Action dated Dec. 9, 2013, 4 pages.

The State Intellectual Property Office of the People's Republic of China Application Serial No. 201210586044.8, Office Action dated Aug. 28, 2014, 6 pages.

European Patent Office Application Serial No. 12198426.4, Search Report dated Mar. 6, 2015, 8 pages.

* cited by examiner

DC POWER RELAY

CROSS-REFERENCE TO RELATED APPLICATIONS

The present application claims priority under 35 U.S.C. §119(a) and 35 U.S.C. §365 to Korean Patent Application No. 10-2011-0146991, filed on Dec. 30, 2011, the contents of which are hereby incorporated by reference herein in their entirety.

BACKGROUND

The present disclosure relates to a DC power relay used for connecting or disconnecting a DC high voltage.

Hybrid vehicles are vehicles in which at least two power sources are used as a driving source. In general, hybrid vehicles are vehicles which utilize an existing internal combustion engine and a motor driven by a battery at the same time. Here, the batteries are recharged using energy generated by the driving of an internal combustion engine or energy lost when being braked. Thus, since the recharged batteries are used for driving vehicles, hybrid vehicles have high-efficiency characteristics when compared to those of existing vehicles which use an internal combustion engine alone.

Such a hybrid vehicle uses an existing engine and a battery as a power source. Particularly, when the hybrid vehicle is initially driven, the hybrid vehicle is accelerated by electricity energy using the battery power source. Then, the battery is repeatedly charged/discharged using the engine and brake according to a running speed. To improve performance of the hybrid vehicle, batteries having higher capacity are required. For this, easiest is to increase a voltage.

Thus, an available voltage of an existing battery, i.e., about 12 V is boosted to about 200 V to about 400V. There is high probability of an additional increase of the battery voltage from now on. As the available voltage of the battery is increased, high insulation performance is required. For this, high-voltage relays for stably turning on/off a power source of a high-voltage battery are being applied to hybrid vehicles.

Such a high-voltage DC relay may break DC current of a high-voltage battery when a contingency arises or according to a control signal of a vehicle controller. Here, an arc may occur when the DC current is connected or disconnected. The arc may have a bad influence on other adjacent instruments or reduce insulation performance. Thus, to adequately control this, a permanent magnet is used. When the permanent magnet is disposed adjacent to a contact of the high-voltage DC relay which generates an arc, the arc may be controlled using a force decided according to intensity and direction of a magnetic flux occurring by the permanent magnet, a current flow direction, and an extension length of the arc. As a result, the arc may be cooled and dissipated. Thus, the DC power relay using the permanent magnet is being applied to electric vehicles such as present hybrid vehicles.

FIG. 1 is a schematic perspective view illustrating an example of a DC power current. Referring to FIG. 1, the DC power relay includes first and second fixed contacts 10 and 11 disposed parallel to each other and a movable contact 12 vertically movably disposed under the fixed contacts 10 and 11. When the movable contact 12 is moved upward to contact the fixed contacts 10 and 11, the DC power relay is turned on. On the other hand, when the movable contact 12 is moved downward and then separated from the fixed contacts 10 and 11, the DC power relay is turned off.

Even as the movable contact 12 is moved downward and thus separated from the fixed contacts 10 and 11, an arc may be generated between the fixed contacts 10 and 11 and the movable contact 12.

Here, if a separate control is not performed, the generated arc may be generated along a straight line between the fixed contacts 10 and 11 and the movable contact 12. As a result, the insulation performance may be reduced, and also, life cycles of adjacent components may be reduced.

To prevent this, first and second permanent magnets 14 and 15 are disposed adjacent to the fixed contact 10 and 11. The permanent magnets 14 and 15 are disposed in a direction perpendicular to that of current flowing through arc plasma to apply a magnetic driving force to the generated arc plasma.

The applied magnetic driving force may separate the arc from the contacts to move the arc in arrow directions, i.e., to the outside. Thus, a distance between the arcs may be increased, and also a length of the arc itself may be extended.

The arc having the extended length may be cooled by gas (air), and thus be changed from a plasma state into an insulated state. This may brake current as well as minimize insulation breaking possibility due to the contact between the arcs.

However, when the movable contact 12 contacts the fixed contacts 10 and 12, and thus the DC power relay is turned on, a downward magnetic driving force is applied to the movable contact 12 on the basis of the Fleming's left-hand law.

Thus, while the DC power relay is turned on, the movable contact 12 may be undesirably separated from the fixed contacts 10 and 11.

SUMMARY

Embodiments provide a DC power relay in which a magnetic flux generated by current flowing into a movable contact when the DC power relay is turned on can be offset to prevent the movable contact from being separated from the fixed contacts.

The feature of the inventive concept is not limited to the aforesaid, but other features not described herein will be clearly understood by those skilled in the art from descriptions below.

In one embodiment, a DC power relay includes: a pair of fixed contacts disposed parallel to each other; a movable contact vertically movable with respect to the pair of fixed contacts, the movable contact being in connect with or being separated from the pair of fixed contacts; a pair of permanent magnets for guide an arc generated when the movable contact is in contact with or is separated from the pair of fixed contacts to the outside; and a damping magnet reducing a force generated in a direction in which the movable contact is separated from the fixed contacts when the movable contact is in contact with the fixed contacts.

A voltage may be applied to one of the pair of fixed contacts so that current flows in a first direction and applied to the other one so that current flows in a second direction opposite to the first direction.

The damping magnet may be disposed under the movable contact.

The damping magnet may include a first damping magnet and a second damping magnet.

The first and second damping magnets may be disposed to have magnetic fluxes opposite to each other.

A magnetic flux generated by the first and second damping magnets may be opposite to a flux induced by current flowing into the movable contact due to the contact between the movable contact and the fixed contacts.

The first and second damping magnets may be disposed horizontally spaced from each other under the movable contact.

Meanwhile, other various effects of the embodiment will be directly or indirectly disclosed in the following detailed description of the embodiment.

DETAILED DESCRIPTION OF THE EMBODIMENTS

Hereinafter, exemplary embodiments will be described in detail with reference to the accompanying drawings. The spirit and scope of the present disclosure, however, shall not be construed as being limited to embodiments provided herein. Rather, it will be apparent that other embodiments that fall within the spirit and scope of the present disclosure may easily be derived through adding, modifying, and deleting elements herein.

Figure 1:
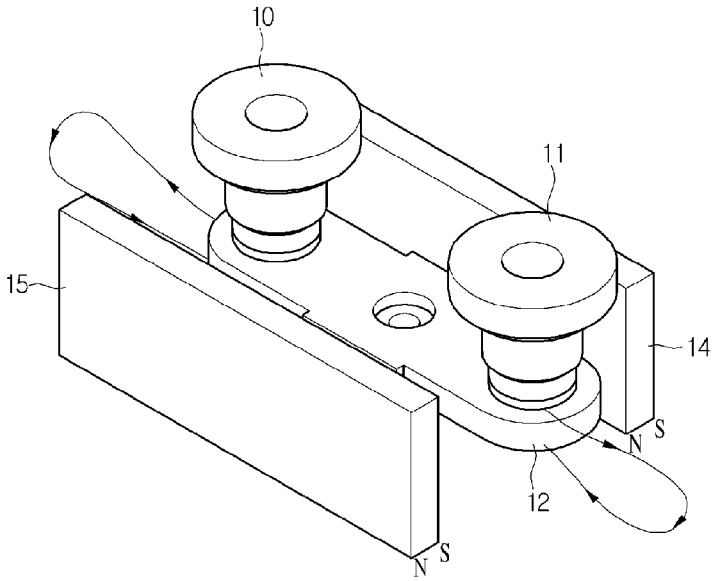
FIG. 1 is a perspective view of a DC power relay according to a related art.
Figure 2:
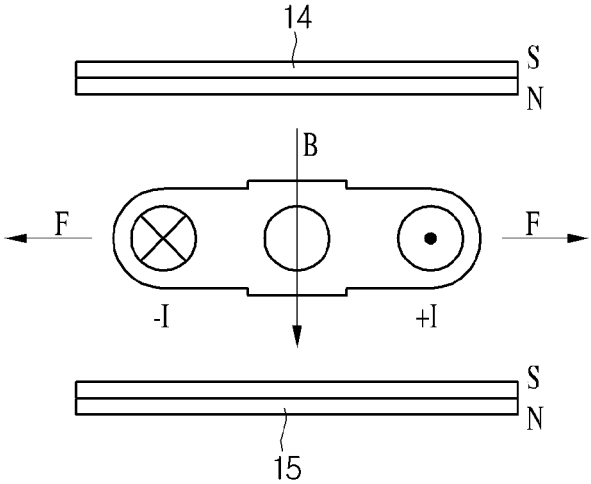
FIG. 2 is a plan view illustrating an operation principle of the DC power relay according to the related art.
Figure 3:
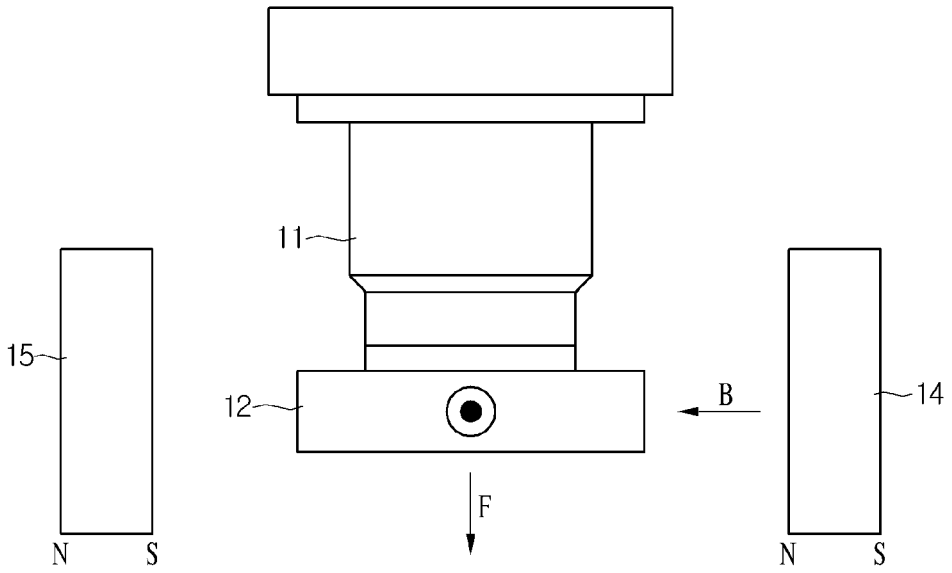
FIG. 3 is lateral view for explaining limitations of the DC power relay according to the related art.
Figure 4:
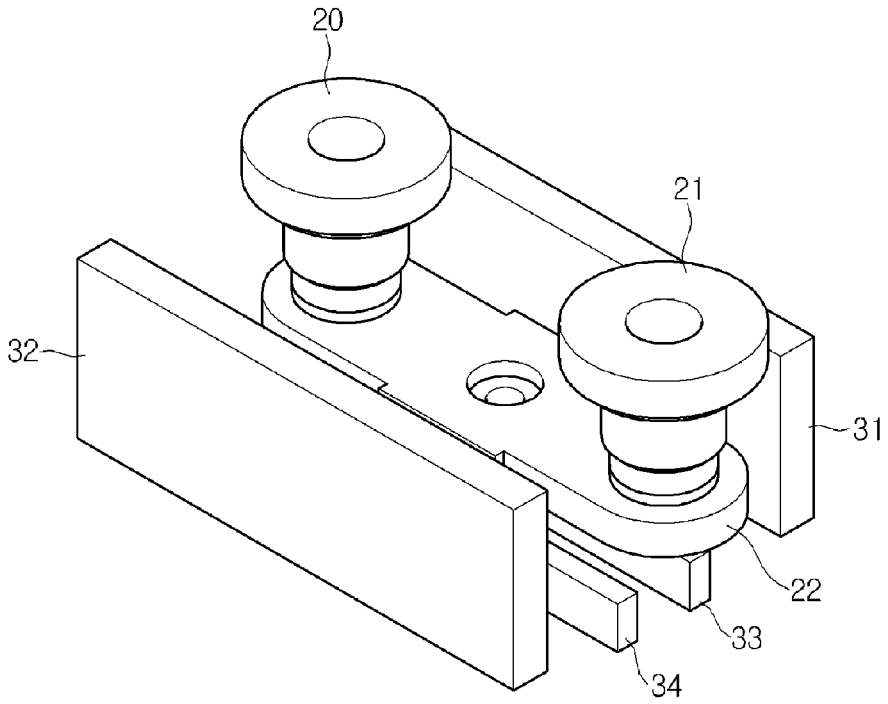
FIG. 4 is a perspective view of a DC power relay according to an embodiment.
Figure 5:
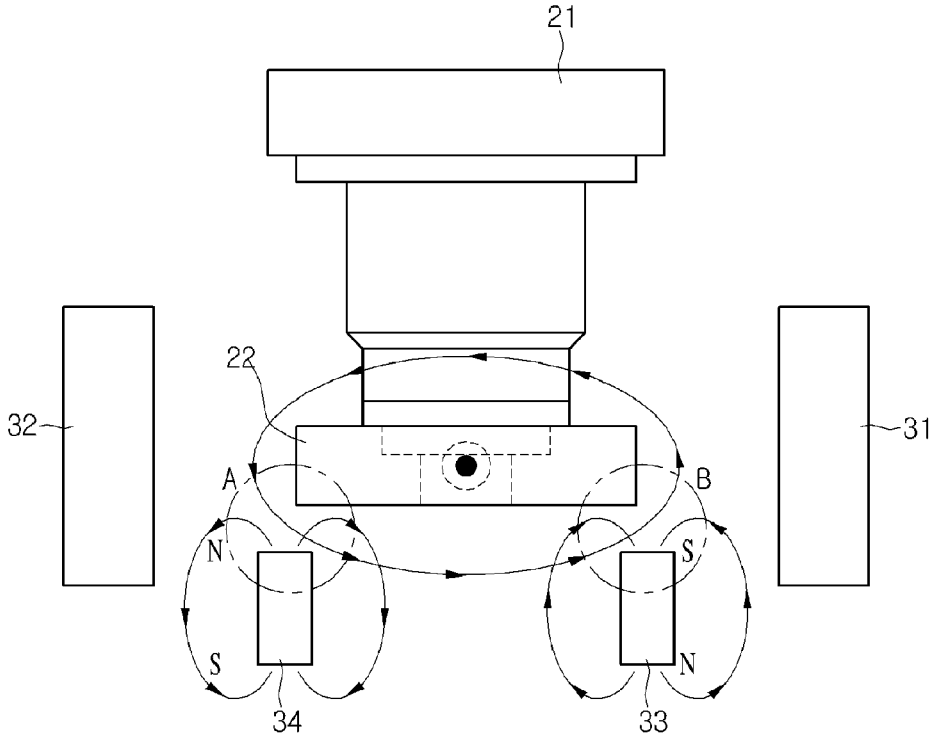
FIG. 5 is a lateral view for explaining an operation principle of the DC power relay according to an embodiment.

FIG. 4 is a perspective view of a DC power relay according to an embodiment. FIG. 5 is a lateral view for explaining an operation principle of the DC power relay according to an embodiment.

Referring to FIG. 4, a DC power relay according to an embodiment includes first and second fixed contacts 20 and 22 fixed to a case (not shown), a movable contact 22 vertically movably disposed under the first and second fixed contacts 20 and 21, first and second permanent magnets 31 and 32 for moving an arc generated between the fixed contacts 20 and 21 and the movable contact 22 to the outside, and first and second damping magnets 33 and 34 for preventing the movable contact 22 from being separated from the fixed contacts 20 and 21 when the DC power relay is turned on.

The fixed contacts 20 and 21 are fixedly disposed on the case. A voltage is applied to the fixed contacts 20 and 21 so that current flows in different directions.

For example, a voltage may be applied to the fixed contacts 20 and 21 so that current may flows downward through one of the fixed contacts 20 or 21 and flows upward through the other one of the fixed contacts 20 or 21.

Thus, when the movable contact 20 contacts the fixed contacts 20 and 21, a circuit in which the current introduced into one of the fixed contacts 20 and 21 is discharged through the other one of the fixed contacts 20 and 21 via the movable contact 22 is formed.

Hereinafter, for convenience of description, a case in which the voltage is applied to the first fixed contact 20 so that the current flows downward and applied to the second fixed contact 21 so that the current flows upward will be described.

The movable contact 22 is vertically movably disposed. Thus, when the movable contact 22 is moved upward to contact the fixed contacts 20 and 21, the DC power relay is turned on. On the other hand, when the movable contact 22 is moved downward and then separated from the fixed contacts 20 and 21, the DC power relay is turned off.

The first and second permanent magnets 31 and 32 are disposed on rear and front surfaces of the first fixed contact 20, the second fixed contact 21, and the movable contact 22, respectively.

The permanent magnets 31 and 32 are disposed so that a magnetic flux is formed from the first permanent magnet 31 toward the second permanent magnet 32. Thus, a portion of the first permanent magnet 31 toward the fixed contacts 20 and 21 and the movable contact 22 is defined as an N polar, and a portion of the second permanent magnet 31 toward the fixed contacts 20 and 21 and the movable contact 22 is defined as an S polar.

Here, if a voltage is applied to the fixed contacts 20 and 21 so that the current flowing into the fixed contacts 20 and 21 flows reversely, the N polar and the S polar of each of the first and second permanent magnets 31 and 32 are reversely disposed.

An arc generated between the contacts when the DC power relay is turned on/off while the movable contact 22 is vertically moved is affected by an external force due to the magnetic flux formed between the permanent magnets 31 and 32 on the basis of the Fleming's left-hand law.

The damping magnets 33 and 34 are disposed under the movable contact 22. The damping magnets 33 and 34 are disposed at positions spaced a preset distance from the movable contact 22 so that the damping magnets 33 and 34 do not contact the movable contact 22 when the movable contact 22 is moved downward. The damping magnets 33 and 34 includes a first damping magnet 33 disposed adjacent to the first permanent magnet 31 and a second damping magnet 34 adjacent to the second permanent magnet 32.

In a case where the damping magnets 33 and 34 are provided, a magnetic flux induced around the movable contact 22 by the current flowing into the movable contact 22 when the DC power relay is turned on is offset by a magnetic flux generated by the damping magnets 33 and 34. Thus, a force of the movable contact 22 which is affected downward is reduced on the basis of the Fleming's left-hand law. Thus, when the DC power relay is turned on, the movable contact 22 is not separated from the fixed contacts 20 and 21.

Referring to FIG. 5, the first damping magnet 33 is disposed so that a portion of the first damping magnet 33 toward the movable contact 22 is defined as an S polar. Also, the second damping magnet 34 is disposed so that a portion of the second damping magnet 34 toward the movable contact 22 is defined as an N polar. The damping magnets 33 and 34 are disposed under side surfaces of the movable contact 22, respectively.

In a region A, a magnetic flux generated by the current flowing into the movable contact 22 flows downward from an upper side. On the other hand, a magnetic flux generated by the second damping magnet 34 flows upward from a lower side. Thus, in the region A, the magnetic flux generated by the current flowing into the movable contact 22 and the magnetic flux generated by the second damping magnet 34 meet each other and thus are offset against each other.

Also, in a region B, a magnetic flux generated by the current flowing into the movable contact 22 flows upward from a lower side. On the other hand, a magnetic flux generated by the first damping magnet 33 flows downward from an upper side. Thus, in the region B, the magnetic flux generated by the current flowing into the movable contact 22 and the magnetic flux generated by the first damping magnet 33 meet each other and thus are offset against each other.

When the magnetic flux generated by the movable contact 22 is offset, the force of the movable contact which is affected downward is offset. Thus, when the DC power relay is turned on, it may prevent the movable contact 22 from being separated from the fixed contacts 20 and 21.

According to the proposed embodiment, when the DC power relay is turned on, it may prevent the fixed contact from being separated.

According to the proposed DC power relay, when the DC power relay is turned on, a magnetic driving force generated in a direction in which the movable contact is separated from the fixed contacts may be reduced.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A DC power relay comprising:

a pair of fixed contacts located parallel to each other;

a movable contact movable with respect to the pair of fixed contacts such that the movable contact may be in contact with or separated from the pair of fixed contacts;

a pair of permanent magnets facing each other for externally guiding an arc generated by the movable contact; and a first damping magnet and a second damping magnet for reducing a force generated in a direction in which the movable contact is separated from the pair of fixed contacts, the first and second damping magnets having opposite magnetic fluxes such that they provide a repulsive force, wherein the first and second damping magnets, the pair of fixed contacts and the movable contact are located between the pair of permanent magnets, wherein a magnetic flux generated by the first damping magnet is opposite to a magnetic flux induced by current flowing into the movable contact when the movable contact is in contact with the pair of fixed contacts, wherein a magnetic flux generated by the second damping magnet is opposite to a flux induced by current flowing into the movable contact when the movable contact is in contact with the pair of fixed contacts.

2. The DC power relay according to claim 1, wherein a voltage is applied to one of the pair of fixed contacts such that current flows in a first direction and is applied to the other of the pair of fixed contacts such that current flows in a second direction opposite to the first direction.

3. The DC power relay according to claim 1, wherein the first and second damping magnets are located under the movable contact.

4. The DC power relay according to claim 3, wherein the first and second damping magnets are horizontally spaced from each other.

* * * * *